United States Patent [19]

Maier et al.

[11] 4,213,301

[45] Jul. 22, 1980

[54] COMPRESSED AIR APPARATUS FOR DRIVING FASTENING ELEMENTS

[75] Inventors: Elmar Maier, Tisis, Austria; Othmar Heeb, Ruggell, Liechtenstein

[73] Assignee: Hilti Aktiengesellschaft, Schaan, Liechtenstein

[21] Appl. No.: 15,612

[22] Filed: Feb. 27, 1979

[30] Foreign Application Priority Data

Mar. 14, 1978 [DE] Fed. Rep. of Germany ..... 2811083

[51] Int. Cl.[2] ..... F15B 11/06

[52] U.S. Cl. ..... 60/407; 60/DIG. 10; 91/170 R

[58] Field of Search ..... 60/370, 371, 407, 412, 60/DIG. 10; 91/170 R

[56] References Cited

U.S. PATENT DOCUMENTS

| | | | |
|---|---|---|---|
| 2,351,872 | 6/1944 | Parker | 91/170 R |
| 2,854,953 | 10/1958 | Osborne | 91/170 R X |
| 3,150,488 | 9/1964 | Haley | 60/371 |
| 3,255,942 | 6/1966 | Bell et al. | 227/8 |

*Primary Examiner*—Edgar W. Geoghegan

*Attorney, Agent, or Firm*—Toren, McGeady and Stanger

[57] ABSTRACT

In an apparatus for driving fastening elements, such as bolts and nails, into receiving material, a first or driving piston is mounted in a first chamber through which it is axially displaceable. A pressure converter arrangement is connected to an inlet to the first chamber for supplying the compressed air required for displacing the first piston for driving in a fastening element. The pressure converter includes a storage chamber, a second chamber in communication with the storage chamber and a third chamber. A double headed piston has one head in the second chamber and the other head in the third chamber. The third chamber has a much greater transverse cross-sectional area than the second chamber. Compressed air supplied to the third chamber compresses air in the second chamber which is directed into the storage chamber. From the storage chamber, the compressed air is charged into the first chamber for driving the first piston forwardly for inserting the fastening element.

6 Claims, 4 Drawing Figures

COMPRESSED AIR APPARATUS FOR DRIVING FASTENING ELEMENTS

SUMMARY OF THE INVENTION

The present invention is directed to an apparatus for inserting fastening elements, such as bolts and nails, into a receiving material in which compressed air is used to propel a driving piston which in turn drives the fastening element.

In the past it has been known to use compressed air as the propelling force in an apparatus for driving fastening elements into a receiving material. The compressed air acts against a drive piston which, in turn, drives the fastening element into the receiving material. Such devices are usually connected to a stationary source of compressed air and are capable of driving the fastening elements only into soft receiving materials, such as wood, carbdoard or the like.

It is known that fastening elements can be driven into hard receiving materials, such as concrete or steel, only if significantly high speeds are used, however, such speeds cannot be developed in the conventional apparatus which is operated by compressed air. The inserting speed or velocity must be kept within specific limits, usually between 30 and 100 meters per second. If the velocity falls below such limits, experience has shown that the fastening element tends to buckle during the driving procedure. On the other hand, if such velocity limits are exceeded, effects similar to those which take placed in hand guns can occur which are unacceptable for safety reasons.

These findings regarding the insertion behavior of fastening elements, such as bolts and nails, has been gained in driving devices which are actuated by explosive powder force.

A notable disadvantage of such driving devices is that, before the fastening element is driven in, a new propellant charge in the form of a cartridge must be inserted and such an operation leads to handling problems and, as a result, to lost time, particularly when a single charge device is being operated under normal construction site conditions. In addition, there is also the disadvantage of the relatively high cost of the cartridges as well as the possibility that they may become lost or fail to ignite. Moreover, such driving devices using explosive powder force require a relatively sensitive ignition mechanism which, for safety reasons, is very expensive.

Accordingly, while fastening element driving devices operated by explosive powder force are suitable for inserting fastening elements into a hard receiving material they have the above-mentioned disadvantages regarding costs, handling and safety, the known driving devices operated by compressed air do not provide sufficient driving energy for propelling fastening elements into a hard receiving material.

Therefore, the primary object of the present invention is to provide a fastening element inserting device which is driven by compressed air and is capable of driving the fastening elements into hard receiving materials and, further, the device affords a compact construction and a fast rate of operation.

In accordance with the present invention, such a compressed air operated fastening element insertion apparatus is provided by:

(a) positioning the driving piston in a chamber so that it can be accelerated by highly compressed air from a rear starting position toward the receiving material and in the starting position the piston head provides a closure for the inlet through which the compressed air is supplied;

(b) a pressure converter supplies the compressed air into the chamber containing the driving cylinder and the converter includes a double headed piston arrangement for providing the higly compressed air used for the driving piston;

(c) the pressure converter includes a storage chamber for storing the highly compressed air before it is charged into the chamber containing the driving piston;

(d) the highly compressed air held in the storage space is produced by a stroke of the double-headed piston of the pressure converter and the amount of air stored is sufficient for one drive stroke of the driving piston; and (e) the driving stroke of the drive piston is commenced only after the completion of the working stroke of the double-headed piston in the pressure converter.

The part of the apparatus containing the drive piston is constructed as a so-called percussion cylinder. This name is derived from the characteristic sudden acceleration of the drive piston within its chamber. The sudden acceleration is achieved by initially admitting the highly compressed air to only a relatively small portion of the rear end surface of the head of the drive piston. This portion of the rear end surface is sealed so that the highly compressed air does not act against the entire rear end surface of the drive piston head until the sealing effect is overcome. When the sealing effect is overcome, the highly compressed air acts on the full rear end surface of the head of the drive piston causing it to be accelerated in the driving direction. The propelling power of the drive piston takes place as the piston moves toward the front end of the chamber in which it is located, the return stroke of the piston takes place after each fastening element insertion step is completed by admitting compressed air into the chamber in front of the piston head. The compressed air supplied into the chamber is advantageously at a pressure only insigificantly greater than atmospheric pressure.

To insert a fastening element into a hard receiving material, the drive piston must travel at a velocity between 30 and 100 meters per second, as explained above. Accordingly, the compressed air must be directed against the drive piston at a sufficient level to provide the desired velocity. It has been established that a pressure of 20 bars is sufficient to provide the required energy for adequately driving the fastening elements into a hard receiving material.

The highly compressed air is supplied by a pressure converter including a double-headed piston with each head located within a separate chamber. One of the chambers has a much smaller transverse cross-sectional area than the other. The small cross-sectional area chamber is in communication with the chamber containing the drive piston. With an assumed ratio of one to six between the heads of the double-headed piston, it is possible to produce compressed air at a pressure of 30 bar by means of a source pressure at a pressure of 5 bar, that is, the 5 bar pressure acts on the piston head having the larger cross-sectional area.

The velocity of the double-headed piston in the pressure converter is, of course, much slower than the working velocity of the drive piston. To afford an adequate energy source for sufficiently accelerating the drive piston, the compressed air produced by the pressure converter is, initially, stored within a storage chamber which is in communication with the chamber containing the drive piston through the smaller cross-sectional area chamber of the pressure converter. At the outset, the highly compressed air in the storage chamber acts only on a relatively small area of the drive piston head and when the seal between the drive piston head and the opening to its chamber is broken the highly compressed air can act on the full crosssectional area of the drive piston head causing it to accelerate to the necessary velocity. Accordingly, the drive piston propels the fastening element forwardly through a tubular muzzle member and drives it into the receiving material.

The volume of the chambers within the pressure converter and also of the storage chamber are dimensioned so that the quantity of compressed air produced in one working stroke of the pressure converter can be retained in the storage space and is sufficient for carrying out one driving stroke of the drive piston. By increasing the size of the chambers, it is possible to generate a sufficient amount of highly compressed air in one stroke of the pressure converter to operate several working strokes of the drive piston.

The pressure converter and the chamber containing the drive piston are controllably coupled so that the working stroke of the drive piston can begin only after the completion of the working stroke of the pressure converter. Accordingly, it is assured that the peak pressure acts on the drive piston and, therefore, the maximum kinetic energy is imparted to the drive piston.

A very compact and mobile apparatus capable of use as a hand-held driving device, can be provided when, in accordance with the present invention, the cylinder forming the chamber for the drive piston and the pressure converter are integrated as a unit with the drive piston and the double-headed piston disposed in axial arrangement one behind the other. Accordingly, it is not necessary to provide connecting lines between the pressure converter and the chamber of the drive piston. Such an arrangement affords a device which does not require much in the way of repairs and does not afford any problems when it is used under the rough conditions experienced at a construction site.

Advantageously, compressed air can be supplied to the smaller cross-sectional area chamber of the pressure converter. By supplying compressed air to each of the heads of the doubleheaded piston, the transmission ratio of the pressure can be increased in accordance with the transverse area of the small piston which permits a smaller construction of the pressure converter at the same pressure level of the compressed air used for driving the drive piston. A requirement in this arrangement is that the smaller cross-sectional area chamber in the pressure converter is sealed from the larger cross-sectional area chamber and receives a separate supply of the compressed air.

To avoid jamming of the drive piston during acceleration, the cylinder forming the drive piston chamber is supported in a casing so that it is slidable in the axial direction. Normally, its front end provides a seal with the casing. When the drive piston is driven forwardly the action of the compressed air on the cylinder displaces it axially rearwardly opening the seal and providing access between the chamber and discharge openings in the casing. As the drive piston is moved in the driving direction, the cylinder is automatically displaced in the rearward direction relative to the casing so that an opening is provided through which the air located in front of the drive piston can be discharged from the chamber assuring that no aircushion is formed which counteracts the acceleration of the piston. The cylinder can be held in its sealed position against the casing by a spring member. The pressure within the chamber during the working stroke of the drive piston overcomes the spring pressure and permits the cylinder to move axially rearwardly.

To facilitate the return of the drive piston to its starting position after a fastening element has been driven, the storage chamber is ventilated via a control valve. The drive piston can be placed in the starting position by supplying pressure in front of the drive piston head within its chamber which pressure is only slightly above atmospheric pressure. The pressure applied in front of the drive piston head causes it to move rearwardly into the starting position.

An especially compact construction of the drive piston cylinder or of the apparatus itself can be achieved if the storage chamber is formed as an annular space laterally enclosing the cylinder forming the chamber of the drive piston. In this arrangement, feed pipes interconnecting the chambers are unnecessary and, furthermore, the drive piston cylinder is protected, especially from contamination from the outside of the casing. Further, it is advantageous to combine the storage chamber with the pressure converter.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
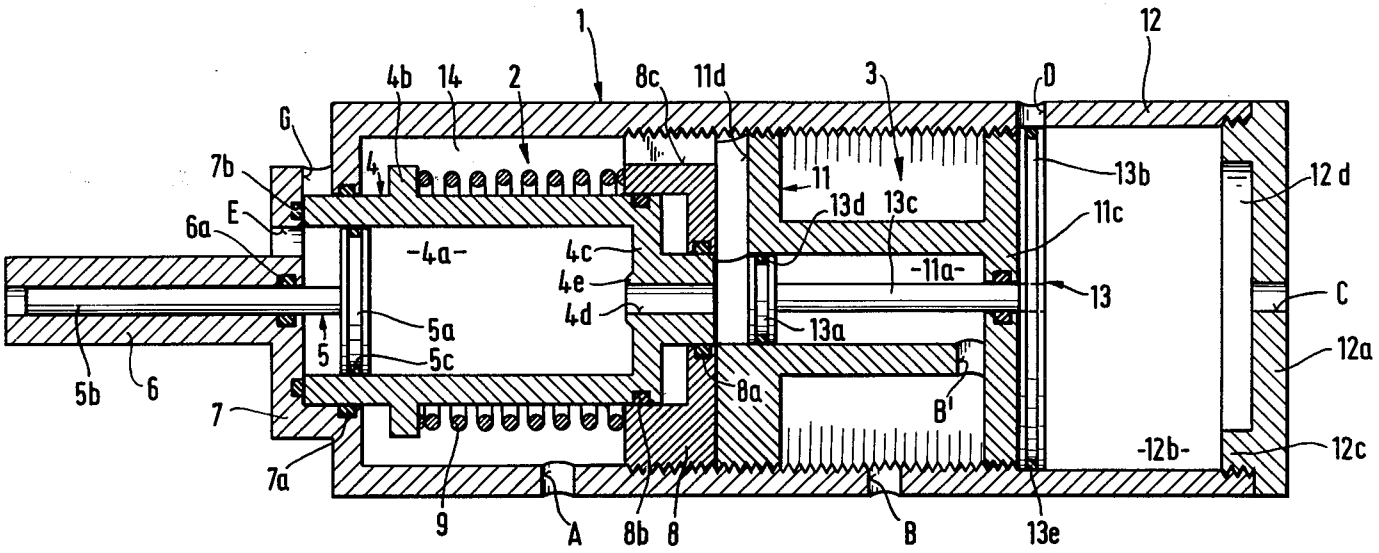
FIG. 1 is a sectional view of a compressed air operated apparatus for driving fastening elements into a receiving material with the various parts of the apparatus in position after a fastening element has been inserted.

In FIG. 1 a compressed air operated device is shown for driving fastening elements into a hard receiving material, such as steel or concrete. As illustrated, the left-hand end of the apparatus is its front or muzzle end and its right-hand end is its rear end, the same directional arrangement applies to the individual parts of the apparatus. The apparatus includes an axially extending casing, that is one extending between the front end and the rear end and containing a drive cylinder 2 within the front portion of the casing. The cylinder 2 is mounted within the casing so that it can move in the axial direction. A pressure converter 3 is located within the casing rearwardly of the drive cylinder 2. The drive cylinder 2 includes an axially extending cylinder 4 containing a drive piston 5 having a piston head 5*a* at its rear end and a shaft 5*b* extending forwardly from the piston head. The piston head 5*a* is guided in the cylindrical chamber 4*a* and the shaft 5*b* extends forwardly into an axially extending tubular muzzle part 6 which forms the front end of the casing. The head 5*a* has a sealing ring 5*c* encircling its circumferential periphery so that a seal is provided with the surface of the chamber 4*a* as the piston is axially displaced through the chamber. Further, a seal ring 6*a* is located within the rearward end of the tubular muzzle part 6 providing a seal with the shaft 5*b* of the drive piston 5. The front end of the cylinder 4, as viewed in FIG. 1, bears against an annular shoulder 7 which forms a part of the casing 1. At the rear end of the cylinder 4, a flange 8 is screwed into the casing 1 so that the rear end of the cylinder can move axially within the flange. The rear end of the cylinder is sealed within the flange 8 by a sealing ring 8*a* and another sealing ring 8*b*. At its front end, the cylinder is sealed to the casing via a sealing ring 7*a*. A spring 9 laterally encloses the cylinder 4 and extends between a shoulder 4*b* extending radially outwardly from the cylinder adjacent its front end and the flange 8 at its rear end. An additional seal is provided between the front end of the cylinder 4 and the juxtaposed surface of the shoulder 7 by a sealing ring 7*b*. At its rearward end the cylinder has a transversely extending base 4*c* containing a centrally arranged bore 4*d* communicating between the chamber 4*a* and the space rearwardly of the cylinder 4. On the surface of the base 4*c* facing into the chamber 4*a*, an annular sealing lip 4*e* is provided which extends around the opening of the central bore 4*d*.

The pressure converter 3 consists of an axially extending insert 11 which is threaded into the casing 1 so that its front end contacts the rear surface of the flange 8. The insert 11 consists of axially extending and transversely extending walls forming a small pressure chamber 11*a* directly rearwardly of the rear end of the cylinder 4. The casing 1 includes a rear casing section 12 closed at its rear end by a transversely extending cover 12*a* which is threaded into the casing section 12. The rear casing section 12 in combination with its cover 12*a* and the rearward surface of the inset 11 forms a large pressure chamber 12*b*. A double-headed piston 13 is located with its small area piston head 13*a* within the small pressure chamber 11*a* and with its large area piston head 13*b* located within the large pressure chamber 12*b*. The double-headed piston in combination with the pressure converter 3 and the rear casing section 12 affords the production of the highly compressed air which is required for driving the drive piston and inserting the fastening elements. The small and large piston heads 13*a*, 13*b* are interconnected by a piston rod 13*c* extending between them. The piston rod 13*c* is in generally axial alignment with the axis of the drive piston chamber 4*a*. An annular seal ring 13*d*, 13*e* laterally encircles each of the small and large piston heads 13*a* and 13*b* to provide a seal with the surface of the chamber in which the heads are located. Further, a seal 11*b*, note FIG. 4, located in the rear end wall 11*c* of the insert 11 provides a seal between the rod and the insert. Accordingly, a hermetic seal is provided between the small pressure chamber 11*a* and the large pressure chamber 12*b*. The forward movement of the double-headed piston 13 is limited by the wall 11*c* of the insert 11 which provides a stop for the large piston head 13*b*, note FIG. 1. The reverse movement of the large piston head of the double headed piston 13 is limited by an annular stop shoulder 12*c* formed on the cover 12*a* at the rear end of the apparatus. Accordingly, radially inwardly of the shoulder 12*c*, a pressure buildup space 12*d* is provided at the rearward end of the large pressure chamber 12*b*.

The highly compressed air produced in the small pressure chamber 11*a* forwardly of the small piston head 13*a* is supplied into an annular storage chamber 14 which laterally encloses the cylinder 4. The compressed air flows through a radially extending channel 11*d* and a groove 8*c* in the flange 8 from the small pressure chamber 11*a* into the storage chamber 14. The storage chamber 14 is formed between the casing 1 and the cylinder 4. Pneumatic control of the apparatus is provided through a plurality of openings A, B, B', C, D and E.

To simplify the following description of the operation of the apparatus, the description is limited to the control function of the openings in each of the different operational stages and to the air pressure conditions required for each stage. The air pressure conditions can be provided conventionally by any pneumatic control circuit and, therefore, because such a control circuit is well known it is not shown or described to simplify the description.

The position of the various movable parts as illustrated in FIG. 1 is the position which these parts assume at the completion of the step of driving a fastening element into a receiving material, not shown. At this point in the operation, the opening A located in the casing 1 forwardly of the flange 8 admits air having a pressure only slightly greater than atmospheric pressure or, for example, the pressure provided by a conventional compressed air source. After passing through opening A the compressed air enters the storage chamber 14, flows through the groove 8*c* and the channel 11*d* into the space forwardly of the small piston head 13*a* and causes the doubleheaded piston 13 to move rearwardly into the starting position shown in FIG. 2. During this movement of the piston 13, the openings B and B' as well as C are kept open to the atmosphere to allow air rearwardly of the heads of the doubleheaded piston to discharge into the atmosphere. Further, the opening D is also kept open to allow the introduction of atmospheric air into the large pressure chamber 12*b* ahead of the piston head 13*b*. If the opening D is not kept open, a partial vacuum would develop in the large pressure chamber 12*b* in front of the piston head 13*b* and the return movement of the double-headed piston to its position in FIG. 2 would tend to be inhibited. During the return movement of the double-headed piston 13, no compressed air is supplied through the opening E. However, as soon as the double-headed piston 13 has reached the position shown in FIG. 2, compressed air is admitted through the opening E, that is, having a slight pressure above atmospheric or the source pressure so that the drive piston 5 is moved from the position shown in FIG. 1 rearwardly through the chamber 4*a* into the starting position illustrated in FIG. 2. To prevent the development of an air cushion in the working space 4*a* rearwardly of the drive piston head 5*a* as the piston moves rearwardly, the opening A is preferably kept open to the atmosphere so that air can move through the bore 4d in the rear end of the cylinder 4 and out through the passage 11d and the groove 8c into the storage chamber 14 and through the opening A. As can be appreciated, the development of an air cushion within the chamber 4a rearwardly of the drive piston would inhibit its return movement to the starting position. The same is true for the openings B or B', C and D.

Figure 2:
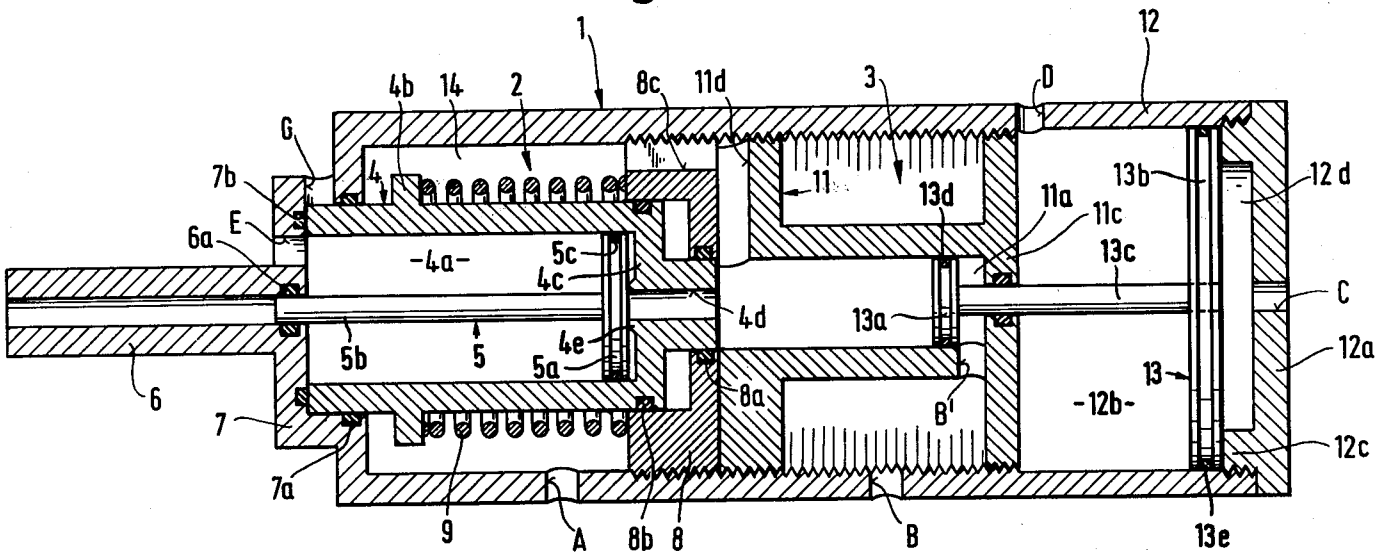
FIG. 2 is a view similar to FIG. 1 with the drive piston displaced axially rearwardly into a ready-to-fire position and with the double-headed piston in the starting position.

After the apparatus is in the position illustrated in FIG. 2, the rearward face of the drive piston 5a is sealed against the sealing lip 4e laterally surrounding the bore 4d through the base of the cylinder 4. The drive piston is kept in this sealed position by the pressure provided through the opening E while the opening A is closed. Next, the compressed air is supplied from a source, not shown, through the opening C into the pressure buildup space 12d at the rearward end of the large pressure chamber 12b. The pressure within the space 12d acts on the rearward surface of the piston head 13b and moves the double-headed piston 13 in the forward direction, that is toward the drive piston 5. This working stroke of the double-headed piston can be additonally supported by the introduction of compressed air through the openings B and B' so that the pressurized air acts against the rearward face of the small piston head 13a. To prevent any interference with the working stroke of the double-headed piston 13, the opening D is kept open to the atmosphere. Accordingly, based on the ratio of the cross-sectional areas of the large piston head 13b and the small piston head 13a, highly pressurized air is developed in the small pressure chamber 11a ahead of the small piston head 13a. This highly compressed air flows from the chamber 11a through the channel 11d and the groove 8c into the storage space 14 laterally enclosing the cylinder 4. The highly pressurized air is maintained in the storage chamber 14 ready for use and it also flows through the central bore 4d in the rear end of the cylinder 4 and acts against the inner circular portion of the rear end surface of the drive piston head 5a defined by the cross-sectional area of the bore 4d, since the rear end surface of the head 5a initially seats in sealed engagement with the lip 4e encircling the opening from the bore 4d. This position of the apparatus is shown in FIG. 3.

Figure 3:
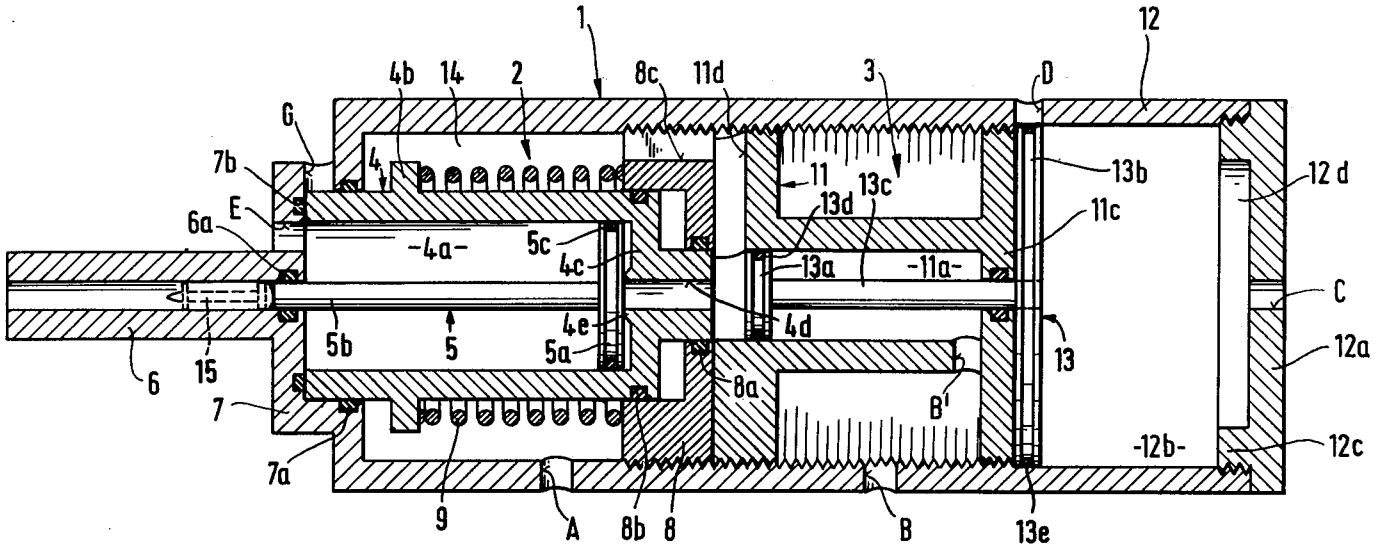
FIG. 3 is a view similar to FIGS. 1 and 2, however, the double-headed piston has moved forwardly for providing the required supply of highly compressed air for use in displacing the drive piston.

The drive piston 5 remains temporarily in the position shown in FIG. 3 because the force of the pressure introduced through opening E acting on the front surface of the piston head 5a is greater than the force exerted on the surface defined by the opening from the bore 4d. After a fastening element 15, note FIGS. 3 and 4, has been inserted into the tubular muzzle part 6 of the casing and the front end of the muzzle portion is pressed against a receiving material, not shown, the pressure acting on the front surface of the piston head 5a is allowed to escape through the opening E. The propulsive thrust acting on the rear surface of the piston head 5a can now displace the piston 5 in the driving direction so that the rear end surface of the head 5a is disengaged from the sealing lip 4e at the commencement of movement. As a result, the highly compressed air from the storage chamber 14 flows over the entire rear end surface of the drive piston head 5a and the drive piston 5 is suddenly accelerated in the forward direction driving the piston element 15 ahead of it out of the tubular muzzle part 6.

Figure 4:
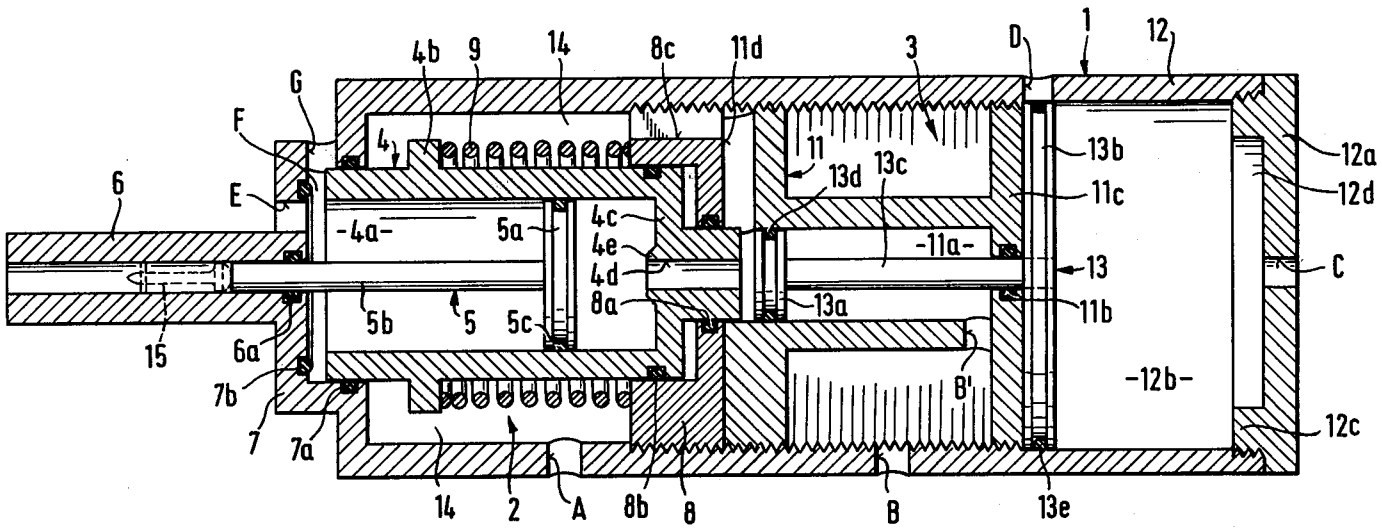
FIG. 4 is a view similar to FIGS. 1–3, however, the highly air compressed air is supplied into the chamber of the drive piston and the drive piston is being accelerated forwardly for driving the fastening element.

In FIG. 4 the drive piston 5 is shown at the commencement of its acceleration forwardly through the chamber 4a. The highly pressurized air acting on the drive piston head 5a also acts on the forwardly facing base 4c of the cylinder pressing it backwardly against the biasing force of the spring 9. The axially rearward movement of the cylinder 4 displaces its forward end from the surface of the annular shoulder 7 and an annular space is opened between the shoulder and the forward end of the cylinder 4. This annular opening permits air in front of the head 5a within the chamber 4a to flow outwardly through the annular space F to the outlet opening G. Accordingly, the possibility of an air cushion being developed in front of the drive piston head 5a is prevented which could result in interference with the forward movement of the drive piston. When the drive piston 5 reaches the position shown in FIG. 1, the driving of the fastening element 15 is completed and the various parts of the apparatus again are in the position as shown in FIG. 1. Accordingly, the action of the spring 9 presses the cylinder axially forwardly into sealing engagement with the rearward surface of the annular shoulder 7. The apparatus has completed one full operational cycle and is ready to commence another cycle from the position shown in FIG. 1.

It is possible to operate the apparatus in a slightly different manner from that described above. For example, the drive piston 5 and the double-headed piston 13 can be returned into the rear positions at the same time. It is also possible that no compressed air from the compressed air source acts on the rear surface of the smaller piston head 13a. It is particularly significant, however, that the dead spaces of the apparatus during operation are properly ventilated during the stroke movements of the pistons 5 and 13 in order to assure the proper axial movement of the pistons. Accordingly, a brief operational time is achieved for carrying out the process of driving in a fastening element.

While specific embodiments of the invention have been shown and described in detail to illustrate the application of the inventive principles, it will be understood that the invention may be embodied otherwise without departing from such principles.

What is claimed is:

1. Apparatus for inserting fastening elements, such as bolts, nails and the like, into a receiving material using compressed air as the driving force, comprising first means defining a first axially extending chamber having a front end and a rear end spaced apart in the axial direction of the chamber, an inlet in the rear end of said chamber for supplying compressed air thereto, a first piston axially displaceably mounted within said first chamber for axial movement therethrough from the rear end toward the front end of the chamber for driving a fastening element from the apparatus, said first piston having a first piston head against which the compressed air acts, said piston head being displaceable betweeen a rear end position and a front end position, in the rear end position said piston head forming a closure for the inlet into the rear end of said chamber, second means for supplying compressed air in said chamber through the inlet in the rear end of said chamber, said second means including a second piston chamber and a third piston chamber each aligned axially with the first piston chamber with the second chamber located between the first chamber and third chamber, the second chamber being in communication with the first chamber through the inlet in the rear end of said first chamber so that compressed air can be supplied from the second chamber into said first chamber through the inlet in the rear end thereof, said third chamber having a considerably greater transverse cross-sectional area than said second chamber, said second means including a storage chamber in communication with said second chamber for storing compressed air to be used for displacing said first piston from the rear end toward the front end of said first chamber, said second means also including a double-headed piston with one head thereof located in said second chamber and the other head thereof located in said third chamber, and a piston shaft interconnecting said heads, said third chamber having a first opening thereto for admitting compressed air into the third chamber for acting against said other head, said second chamber having an opening thereto, said double-headed piston arranged to supply a sufficient amount of compressed air to said storage chamber for driving said first piston from the rear end to the front end of said first chamber, before said first piston is driven by the stored compressed air.

2. Apparatus, as set forth in claim 1, wherein an axially extending casing forms the outer part of said apparatus, said first means includes a first cylinder located in the front end of said casing and forming the lateral surface of said first chamber, said second means located within said casing axially rearwardly of said first cylinder so that said casing, said first means and said second means form a unitary construction having said drive piston and said double-headed piston in axial arrangement with said double-headed piston located rearwardly of said driving piston.

3. Apparatus, as set forth in claim 2, wherein openings are formed in said casing and in said second means for introducing compressed air into said second piston chamber so that the compressed air can act on the rear surface of said one head of said double-headed piston.

4. Apparatus, as set forth in claim 2, wherein said cylinder laterally forming said first chamber is supported in said casing so that the front end of said cylinder contacts said casing, spring means in said casing for biasing said cylinder into contact with the front surface of said casing, the pressure of said spring being selected so that when compressed air is admitted into said chamber across the full rearward surface of said first piston, said cylinder is displaced axially rearwardly against the biasing action of said spring and is displaced from the front end of said casing so that air within said first chamber can flow outwardly ahead of said head of said first piston as said first piston is moved axially forwardly toward the front end of said chamber.

5. Apparatus, as set forth in claim 4, wherein said storage space is formed between said casing and said cylinder and said casing includes an opening therethrough into said storage space for facilitating the discharge of air from said first chamber into said storage chamber and through said opening when said first piston is moved in the rearward direction.

6. Apparatus, as set forth in claim 5, wherein said storage chamber comprises an annular space defined inwardly by said cylinder and outwardly by said casing.

* * * * *